US012473699B2

(12) United States Patent
Zhang et al.

(10) Patent No.: US 12,473,699 B2
(45) Date of Patent: Nov. 18, 2025

(54) STEEL-CONCRETE COMPOSITE WEB AND CONSTRUCTION METHOD THEREOF

(71) Applicants: Guangxi Beitou Highway Construction Investment Group Co., Ltd., Nanning (CN); Guangxi Qianglu Engineering Consulting Co., Ltd., Nanning (CN); Guangxi Road Construction Investment Co., Ltd., Nanning (CN)

(72) Inventors: Yun Zhang, Nanning (CN); Yuqing Liu, Nanning (CN); Xiaorong Zhou, Nanning (CN); Tingyi Luo, Nanning (CN); Sihao Wang, Nanning (CN); Yuan Ye, Nanning (CN); Haochu Cai, Nanning (CN); Ming Yang, Nanning (CN); Yasen Tang, Nanning (CN); Chunxiu Qin, Nanning (CN); Changzhou Xie, Nanning (CN)

(73) Assignees: Guangxi Beitou Highway Construction Investment Group Co., Ltd., Nanning (CN); Guangxi Qianglu Engineering Consulting Co., Ltd., Nanning (CN); Guangxi Road Construction Investment Co., Ltd., Nanning (CN)

( * ) Notice: Subject to any disclaimer, the term of this patent is extended or adjusted under 35 U.S.C. 154(b) by 804 days.

(21) Appl. No.: 17/807,990

(22) Filed: Jun. 21, 2022

(65) Prior Publication Data

US 2022/0403610 A1 Dec. 22, 2022

(30) Foreign Application Priority Data

Jun. 22, 2021 (CN) ..... 202110691837.5

(51) Int. Cl.
*E01D 2/04* (2006.01)
*E01D 101/26* (2006.01)

(52) U.S. Cl.
CPC ..... *E01D 2/04* (2013.01); *E01D 2101/262* (2013.01); *E01D 2101/268* (2013.01)

(58) Field of Classification Search
CPC ..... E01D 2/04; E01D 2101/262; E01D 2101/268; E01D 2/00; E01D 19/00; E01D 19/067; E01D 21/00
See application file for complete search history.

(56) References Cited

U.S. PATENT DOCUMENTS 3,367,074 A * 2/1968 Vanich ..... E01D 6/00 52/693
4,129,917 A * 12/1978 Sivachenko ..... E01D 11/02 52/843

(Continued)

FOREIGN PATENT DOCUMENTS

CN 203514196 U * 4/2014
CN 207130604 U * 3/2018

(Continued)

*Primary Examiner* — Abigail A Risic
(74) *Attorney, Agent, or Firm* — DLA Piper LLP (US)

(57) ABSTRACT

Disclosed are a steel-concrete composite web and a construction method thereof, and relate to the field of bridge engineering. The steel-concrete composite web comprises a plurality of prefabricated web segments connected in sequence, wherein each prefabricated web segment comprises a corrugated steel web and a concrete encasement, each concrete encasement is arranged on the inner side of the corresponding corrugated steel web. The right and left edges of adjacent corrugated steel web segments are connected, and a pouring space is formed between adjacent concrete encasements; and each concrete encasement is provided with joint reinforcing rebars used for stretching into the pouring space, first concrete is poured into the pouring space (Continued)

to form a cast-in-place wet joint, and the joint reinforcing rebars are embedded into the cast-in-place wet joint.

13 Claims, 3 Drawing Sheets

(56) References Cited

U.S. PATENT DOCUMENTS

| | | | | | |
|---|---|---|---|---|---|
| 4,201,020 | A * | 5/1980 | Saunders | E04C 2/36 52/745.1 |
| 4,912,794 | A * | 4/1990 | Thivans | E01D 2/02 14/4 |
| 5,134,741 | A * | 8/1992 | Carcassi | E01D 2/04 425/65 |
| 6,574,818 | B1 * | 6/2003 | Matiere | E01D 19/125 14/77.1 |
| 7,861,346 | B2 * | 1/2011 | Wilson | E01D 19/125 14/24 |
| 2023/0057146 | A1 * | 2/2023 | Von Handorf | E01D 19/02 |

FOREIGN PATENT DOCUMENTS

| | | | | | |
|---|---|---|---|---|---|
| CN | 109989331 | A | * | 7/2019 | |
| CN | 111441235 | A | * | 7/2020 | E01D 19/00 |
| JP | 2001342611 | A | * | 12/2001 | |
| JP | 2002250009 | A | * | 9/2002 | |
| JP | 4347500 | B2 | * | 10/2009 | |
| KR | 101310039 | B1 | * | 9/2013 | |
| SE | 2150967 | A1 | * | 1/2023 | |

* cited by examiner

STEEL-CONCRETE COMPOSITE WEB AND CONSTRUCTION METHOD THEREOF

CROSS REFERENCE TO RELATED APPLICATION

This application claims priority to Chinese Patent Application No. 202110691837.5, filed Jun. 22, 2021, which is herein incorporated by reference in its entirety.

TECHNICAL FIELD

The present disclosure relates to the field of bridge engineering, in particular to a steel-concrete composite web and a construction method thereof.

BACKGROUND ART

The composite girder bridge with corrugated steel webs adopts the corrugated steel web to replace the concrete web of a traditional concrete box girder. By utilizing the characteristic of low longitudinal rigidity of the corrugated steel web, the constraint between the top and bottom concrete slabs is relieved, the secondary internal force is reduced, the prestressing efficiency is improved, and the self-weight of the bridge structure is reduced. The composite girder bridge with corrugated steel webs is actively popularized in China in recent years.

At present, most of the composite bridges with corrugated steel webs built worldwide are continuous or continuous rigid girder bridges, and the span of the bridges is continuously increased. The maximum span has reached 185 m, and the girder depth at the intermediate support has exceeded 10 m. The shear stability of the corrugated steel web becomes a main control factor for design due to large hogging moment and shearing force at the intermediate support. At present, concrete is usually encased in the inner side of the steel web to form a steel-concrete composite web, thus the shear stability of the web can be improved.

The concrete encasement can improve the stability of the corrugated steel web efficiently. The length of the concrete encasement is usually designed to be 1-1.5 times of the girder depth. However, the construction of the concrete encasement is difficult, especially for bridges with large spans. The girder depth is higher, and the height of the web at the intermediate support section is larger, the length of the concrete encasement in the inner side of the corrugated steel web is further increased, so the formwork erection, reinforcement assembling and concrete pouring become more difficult, the construction efficiency is seriously influenced, and the concrete pouring quality is hard to be guaranteed.

Therefore, how to overcome these shortcomings becomes an urgent problem to be solved by those skilled in the art.

SUMMARY

In order to solve the technical problem, the present disclosure provides a steel-concrete composite web and a construction method thereof. The construction process is simplified, the pouring quality of the concrete encasement is improved, and the construction efficiency is improved.

In order to achieve the purpose, the present disclosure provides the following scheme.

The present disclosure describes a steel-concrete composite web. The steel-concrete composite web comprises a plurality of prefabricated web segments connected in sequence, wherein each prefabricated web segment comprises a corrugated steel web and inner concrete encasement, each concrete encasement is arranged in the inner side of the corresponding corrugated steel web, the adjacent corrugated steel webs are welded during construction, and a pouring space is reserved between the left and right surfaces of adjacent concrete encasements; and each concrete encasement is provided with joint reinforcing rebars used for stretching into the pouring space, first concrete is poured into the pouring space to form a cast-in-place wet joint, and the joint reinforcing rebars are embedded into the cast-in-place wet joint.

Preferably, an upper steel flange and a lower steel flange are welded at the top and bottom edges of each corrugated steel web respectively. A mold cavity is formed by the upper steel flange, the lower steel flange and the inner face of the corrugated steel web. The concrete is poured into the mold cavity to form the concrete encasement.

Preferably, the perforated steel plates are welded on the upper steel plate and the lower flange plate. The perforated steel plates are used to connect the top concrete slab and the bottom concrete slab with the corrugated steel web.

Preferably, shear connectors are arranged on the inner face of the corrugated steel to provide connection between the concrete encasement and the corrugated steel web, and the shear connectors are embedded into the concrete encasement after construction.

Preferably, the left and right edges of the corrugated steel web protrude out of the left and right sides of the concrete encasement respectively, so that the pouring space is formed between the two adjacent composite web segments.

Preferably, the left and right edges of each corrugated steel web are in welded connection.

Preferably, the joint reinforcing rebars extending into the same pouring space are bound together.

The present disclosure also provides a construction method of the steel-concrete composite web, comprising the following steps: prefabricating the prefabricated composite web segments; hoisting the prefabricated web segments to the position in a real bridge girder, and positioning and fixing the prefabricated web segments; connecting the adjacent corrugated steel webs; and pouring the joint concrete into the pouring space.

Compared with the prior art, the present disclosure has the following technical effects.

The steel-concrete composite web provided by the present disclosure comprises a plurality of prefabricated web segments connected in sequence, wherein each prefabricated web segment comprises a corrugated steel web and a concrete encasement, each concrete encasement is arranged on one side of the corresponding corrugated steel web, the right and left edges of adjacent corrugated steel webs are welded, and a pouring space is formed between the two opposite sides of adjacent concrete encasements; and each concrete encasement is provided with joint reinforcing rebars used for stretching into the pouring space, first concrete is poured into the pouring space to form a cast-in-place wet joint, and the joint reinforcing rebars are embedded into the cast-in-place wet joint. The steel-concrete composite web is prefabricated in sections. During specific construction, the prefabricated web segments are prefabricated in advance, then the prefabricated web segments are hoisted to the position in a real bridge girder for being positioned and fixed, then the adjacent corrugated steel webs are connected, and the first concrete is poured in the pouring space. According to the steel-concrete composite web, tedious procedures such as formwork erecting, reinforcement assembling and concrete encasement pouring on the construction site are avoided, the construction process is simplified, and the concrete encasement pouring quality is improved. Only a small amount of wet joint concrete needs to be poured on site, construction is convenient and fast, and the construction efficiency is high.

BRIEF DESCRIPTION OF THE DRAWINGS

To more clearly illustrate the embodiment of the present disclosure or the technical scheme in the prior art, the following briefly introduces the attached figures to be used in the embodiment. Apparently, the attached figures in the following description show merely some embodiments of the present disclosure, and those skilled in the art may still derive other drawings from these attached figures without creative efforts.

Figure 1:
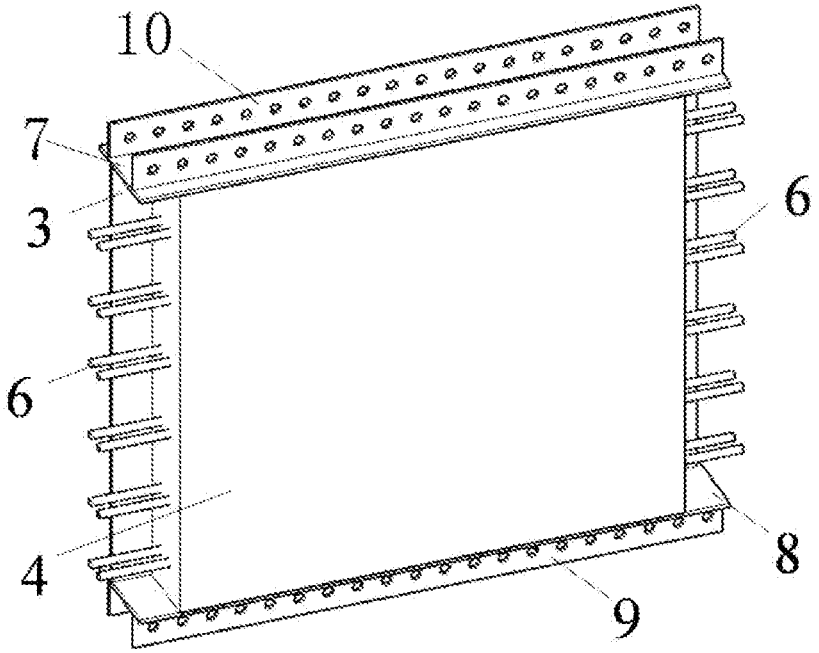
FIG. 1 is a structural schematic diagram of a prefabricated web segment in an embodiment of the present disclosure.
Figure 2:
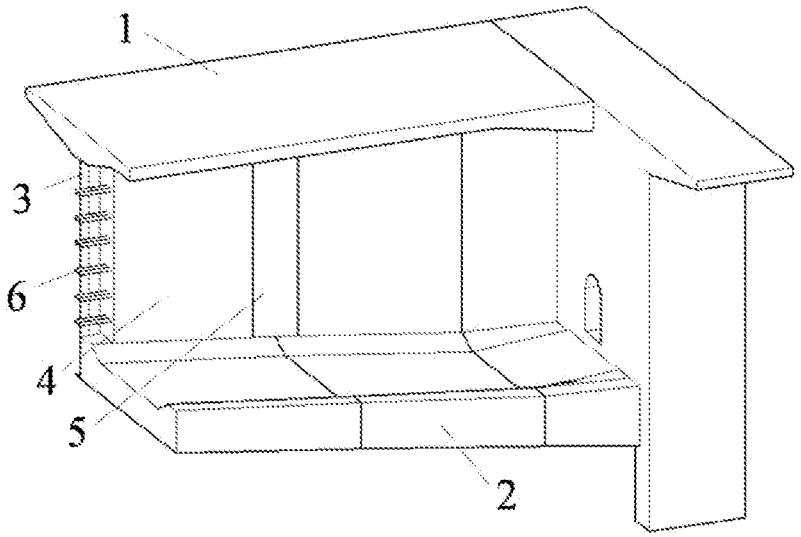
FIG. 2 is a schematic diagram of a mode that a top concrete slab and a bottom concrete slab are matched with a prefabricated steel-concrete composite web provided in the embodiment of the present disclosure.
Figure 3:
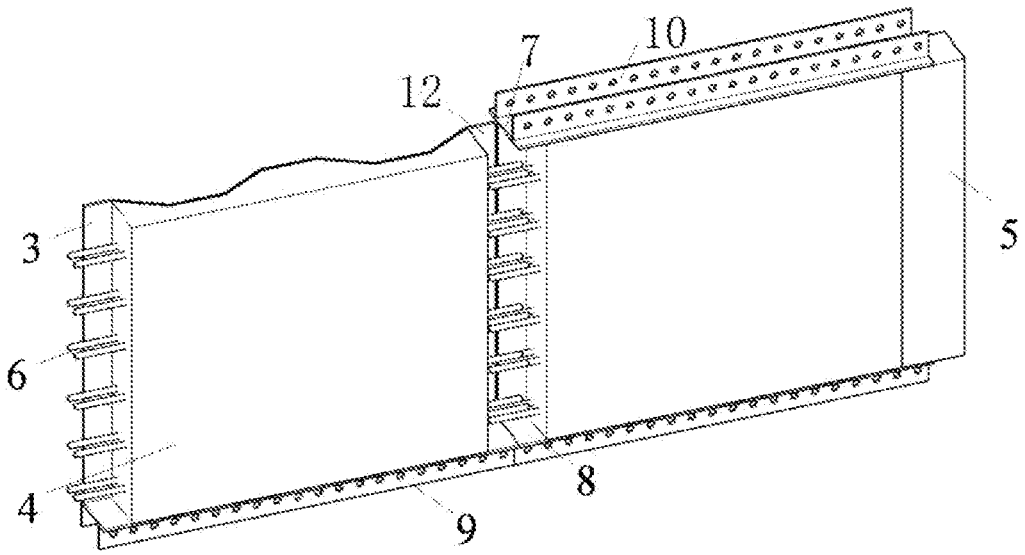
FIG. 3 is a schematic diagram of a setting mode of a pouring space.

Reference signs in attached figures: 1, top concrete slab; 2, bottom concrete slab; 3, corrugated steel web; 4, concrete encasement; 5, cast-in-place wet joint; 6, joint reinforcing rebar; 7, upper steel flange; 8, lower steel flange; 9, lower perforated steel plate; 10, upper perforated steel plate; 11, shear connector; and 12, pouring space.

DETAILED DESCRIPTION OF THE EMBODIMENTS

The following clearly and completely describes the technical scheme in the embodiments of the present disclosure with reference to the attached figures in the embodiments of the present disclosure. The described embodiments are merely a part rather than all of the embodiments of the present disclosure. Based on the embodiment in the present disclosure, all other embodiments obtained by the ordinary technical staff in the art under the premise of without contributing creative labor belong to the scope protected by the present disclosure.

The present disclosure aims to describe a steel-concrete composite web which is simple, convenient and rapid in construction and high pouring quality and a construction method thereof.

To make the foregoing objective, features and advantages of the present disclosure clearer and more comprehensible, the present disclosure is further described in detail below with reference to the attached figures and specific embodiments.

As shown in FIG. 1 to FIG. 5, the steel-concrete composite web provided by the embodiment comprises a plurality of prefabricated web segments connected in sequence, wherein each prefabricated web segment comprises a corrugated steel web 3 and a concrete encasement 4, each concrete encasement 4 is arranged on one side of the corresponding corrugated steel web 3, the right and left sides of adjacent corrugated steel webs are connected, and a pouring space 12 is formed between the right and left sides of adjacent concrete encasements 4; and each concrete encasement 4 is provided with joint reinforcing rebars 6 used for stretching into the pouring space 12, first concrete is poured into the pouring space 12 to form a cast-in-place wet joint 5, and the joint reinforcing rebars 6 are embedded into the cast-in-place wet joint 5.

A construction method of the steel-concrete composite web provided by the embodiment comprises the following steps: prefabricating the composite web segments; hoisting the prefabricated composite web segments to the position of a real bridge girder, and positioning and fixing the prefabricated web segments; connecting the adjacent corrugated steel webs 3; and pouring the first concrete into the pouring space 12.

Concrete encasement of the steel-concrete composite web is prefabricated, and the cast-in-place wet joint 5 is poured to form the composite web. Through the arrangement, complicated procedures such as formwork erecting, reinforcing rebar binding and concrete encasement pouring on a construction site are avoided, the construction process is simplified, the concrete encasement pouring quality is improved, the construction speed is increased, and the construction efficiency is improved.

In the embodiment, as shown in FIG. 1, an upper steel flange 7 and a lower steel flange 8 are arranged at the top and bottom edges of each corrugated steel web 3 respectively and used for connection with a top concrete slab 1 and a bottom concrete slab 2 respectively, a mold cavity is formed by the upper steel flange 7, the lower steel flange 8 and one face of the corrugated steel web 3, and second concrete is poured into the mold cavity to form the concrete encasement 4. During prefabrication in a factory, the upper steel flange 7 and the lower steel flange 8 are connected with the two ends of the corrugated steel web 3 respectively, and then the concrete encasement 4 is poured as a formwork by forming the mold cavity on one face of the upper steel flange 7, one face of the lower steel flange 8 and one face of the corrugated steel web 3; and through the arrangement, the concrete encasement 4 is convenient to pour. It needs to be noted that the top concrete slab 1 and the bottom concrete slab 2 belong to a part of an existing bridge, and the detailed structure is not repeated.

In the embodiment, as shown in FIG. 1, the upper steel flange 7 and the lower steel flange 8 are provided with an upper perforated steel plate 10 and a lower perforated steel plate 9 respectively, and the upper perforated steel plate 10 and the lower perforated steel plate 9 are used for connecting the top concrete slab 1 and the bottom concrete slab 2 respectively. In the concrete construction process, after the cast-in-place wet joint 5 reaches the design strength, the top concrete slab 1 and the bottom concrete slab 2 are respectively poured on the upper perforated steel plate 10 and the lower perforated steel plate 9. The upper perforated steel plate 10 and the lower perforated steel plate 9 are both of a plate-shaped structure, the upper perforated steel plate 10 is provided with a plurality of first holes in the length direction of the upper perforated steel plate 10, the lower perforated steel plate 9 is provided with a plurality of second holes in the length direction of the lower perforated steel plate 9, and when the top concrete slab 1 and the bottom concrete slab 2 are poured, concrete penetrates through the first and second holes. Through the arrangement, the connection between the bottom concrete slab 2 and the top concrete slab 1 with the steel-concrete composite web is better.

Figure 4:
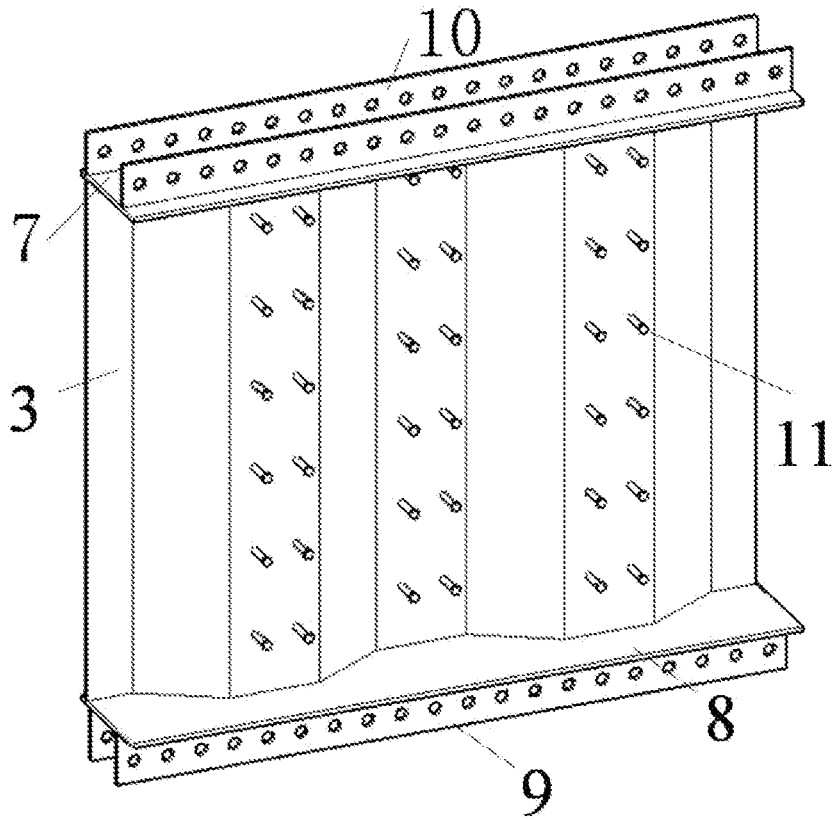
FIG. 4 is a schematic diagram of a setting mode of shear connectors.
Figure 5:
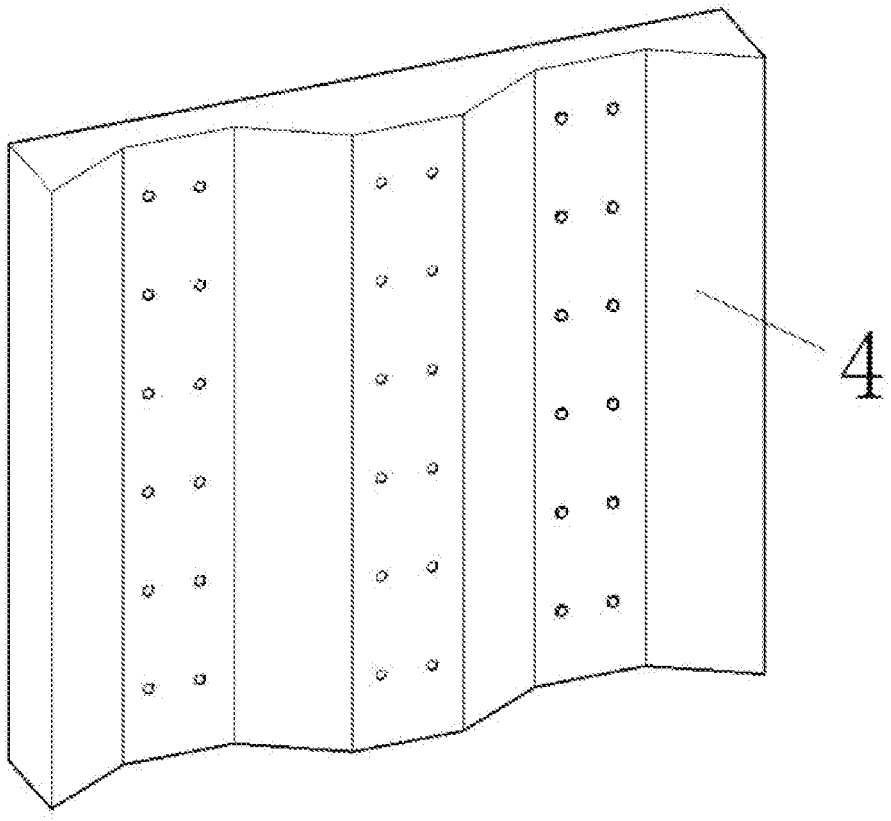
FIG. 5 is a structural schematic diagram of a concrete encasement in the embodiment of the present disclosure.

In the embodiment, as shown in FIG. 4, shear connectors 11 are arranged on the inner surface of the corrugated steel web 3, provided with the concrete encasement 4, and shear connectors 11 are embedded into the concrete encasement 4.

Specifically, when the prefabricated web segments are prefabricated, shear connectors 11 are arranged on one face of the corrugated steel web 3, then concrete is poured on the face, provided with the shear connectors 11, of the corrugated steel web 3 to form the concrete encasement 4, and after pouring is completed, shear connectors 11 are embedded into the concrete encasement 4. By arranging the shear connectors 11, the corrugated steel web 3 and the concrete encasement 4 are connected more firmly. The specific structure of the shear connectors 11 belongs to the prior art. For example, one or more of welded studs 11, a perforated plate connector 11 or an angle steel connector 11 can be selected.

In the embodiment, specifically, the two edges of the corrugated steel web 3 protrude out of the right and left surfaces of the concrete encasement 4 respectively, so that the pouring space 12 is formed between any two adjacent concrete encasements 4.

In the embodiment, specifically, the left and right edges of any two adjacent corrugated steel webs are welded.

In the embodiment, in order to improve the strength of the prefabricated web segments, the joint reinforcing rebars 6 extending into the same pouring space 12 are bound and fixed together. In the embodiment, specifically, one end of the joint reinforcing rebar 6 is embedded into the concrete encasement 4, the other end of the joint reinforcing rebar 6 extends out of the concrete encasement 4, and each concrete encasement 4 is provided with a plurality of joint reinforcing rebars 6 in the height direction. In addition, the length of wet joint 5 and the type of the joint reinforcing rebar 6 are determined according to actual conditions.

Specific examples are used for illustration of the principles and implementation methods of the present disclosure. The description of the above-mentioned embodiments is used to help illustrate the method and the core principles of the present disclosure; and meanwhile, those skilled in the art can make various modifications in terms of specific embodiments and scope of application in accordance with the teachings of the present disclosure. In conclusion, the content of this specification shall not be construed as a limitation to the present disclosure.

What is claimed is:

1. A steel-concrete composite web, comprising a plurality of prefabricated web segments connected in sequence, wherein each prefabricated web segment comprises a corrugated steel web and a concrete encasement, each concrete encasement is arranged on one side of a corresponding corrugated steel web, the left and right edges of adjacent corrugated steel webs are connected to each other, forming a pouring space between a left surface and a right surface of adjacent concrete encasements; and each concrete encasement is provided with joint reinforcing rebars used for stretching extending into the pouring space, first concrete is poured into the pouring space to form a cast-in-place wet joint, and the joint reinforcing rebars are embedded into the cast-in-place wet joint;

wherein the left and right edges of the corrugated steel web protrude out of the left and right surfaces of the concrete encasement, so that the pouring space is formed between adjacent concrete encasement segments.

2. The steel-concrete composite web according to claim 1, wherein an upper steel flange and a lower steel flange are respectively arranged at an upper edge and a lower edges of each corrugated steel web, a mold cavity is formed by the upper steel flange, the lower steel flange and an inner surface of the corrugated steel web, and then concrete is poured into the mold cavity to form the concrete encasement.

3. The steel-concrete composite web according to claim 2, wherein the upper steel flange and the lower steel flange are respectively provided with an upper perforated steel plate and a lower perforated steel plate, and the upper perforated steel plate and the lower perforated steel plate are configured to connect a top concrete slab and a bottom slab with the corrugated steel web.

4. The steel-concrete composite web according to claim 1, wherein shear studs are arranged on the inner surface of the corrugated steel web, provided with the concrete encasement, and the shear studs are embedded into the concrete encasement.

5. The steel-concrete composite web according to claim 1, wherein the left and right edges of adjacent corrugated steel webs are connected by welding or bolting.

6. The steel-concrete composite web according to claim 1, wherein the joint reinforcing rebars of adjacent concrete encasements extends into a center pouring space and are bound together.

7. A construction method of the steel-concrete composite web according to claim 1, comprising the following steps:

prefabricating the prefabricated web segments;

hoisting the prefabricated web segments to a designed position of a real bridge girder, and positioning and fixing the prefabricated web segments;

connecting the adjacent corrugated steel webs; and pouring the first concrete into the pouring space;

wherein the left and right edges of the corrugated steel web protrude out of left and right surfaces of the concrete encasement respectively, so that the pouring space is formed between adjacent concrete encasements.

8. The construction method according to claim 7, wherein an upper steel flange and a lower steel flange are respectively arranged at the upper edge and the lower edge of each corrugated steel web and configured to connect with a top concrete slab and a bottom concrete slab respectively, a mold cavity is formed by the upper steel flange, the lower steel flange and the inner surface of the corrugated steel web, and second concrete is poured into the mold cavity to form the concrete encasement.

9. The construction method according to claim 8, wherein the upper steel flange and the lower steel flange are provided with an upper perforated steel plate and a lower perforated steel plate respectively, and the upper perforated steel plate and the lower perforated steel plate are used for being connected with the top concrete slab and the bottom concrete slab respectively.

10. The construction method according to claim 7, wherein a connecting piece is arranged on a face, provided with the concrete encasement, of the corrugated steel web, and one or more shear studs are embedded into the concrete encasement.

11. The construction method according to claim 7, wherein the left and right edges of the corrugated steel web protrude out of left and right surfaces of the concrete encasement respectively, so that the pouring space is formed between adjacent concrete encasements.

12. The construction method according to claim 11, wherein the left and right edges of adjacent corrugated steel webs are connected by welding or bolting.

13. The construction method according to claim 7, wherein the joint reinforcing rebars extending into a same pouring space are bound together.

* * * * *